US009244414B2

(12) United States Patent
Yamazaki

(10) Patent No.: US 9,244,414 B2
(45) Date of Patent: Jan. 26, 2016

(54) INFORMATION PROCESSING DEVICE, AND NON-TRANSITORY COMPUTER READABLE MEDIUM STORING PROGRAM

(71) Applicant: FUJI XEROX CO., LTD., Tokyo (JP)

(72) Inventor: Yasuhiro Yamazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/452,095

(22) Filed: Aug. 5, 2014

(65) Prior Publication Data

US 2015/0277323 A1 Oct. 1, 2015

(30) Foreign Application Priority Data

Mar. 26, 2014 (JP) ..... 2014-062829

(51) Int. Cl.
*G03G 15/00* (2006.01)

(52) U.S. Cl.
CPC ..... *G03G 15/5012* (2013.01); *G03G 15/70* (2013.01)

(58) Field of Classification Search
CPC .... G03G 15/00; G03G 15/5012; G03G 15/70
USPC ..... 399/21
See application file for complete search history.

(56) References Cited

U.S. PATENT DOCUMENTS 4,609,919 A * 9/1986 Miyazaki et al. ..... 345/56
5,359,392 A * 10/1994 Muto ..... G03G 15/2003 219/216
2010/0021202 A1* 1/2010 Okano ..... 399/114
2010/0074636 A1* 3/2010 Okano ..... G03G 15/55 399/21

FOREIGN PATENT DOCUMENTS

JP A-3-138253 6/1991
JP A-5-323707 12/1993
JP 11109801 A * 4/1999 ..... G03G 15/00

* cited by examiner

*Primary Examiner* — Nguyen Ha
(74) *Attorney, Agent, or Firm* — Oliff PLC

(57) ABSTRACT

Provided is an information processing device, including an opening and closing detection unit that detects opening and closing of an opening and closing door which exposes a paper transporting passage for transporting paper, a paper jam detection unit that detects a paper jam in the paper transporting passage, a time measurement unit that measures a time when the paper jam is detected and opening of the opening and closing door is detected, and a control unit that controls the paper jam to be continued when a time measured by the time measurement unit is shorter than a predetermined time in case of detecting closing of the opening and closing door.

21 Claims, 13 Drawing Sheets

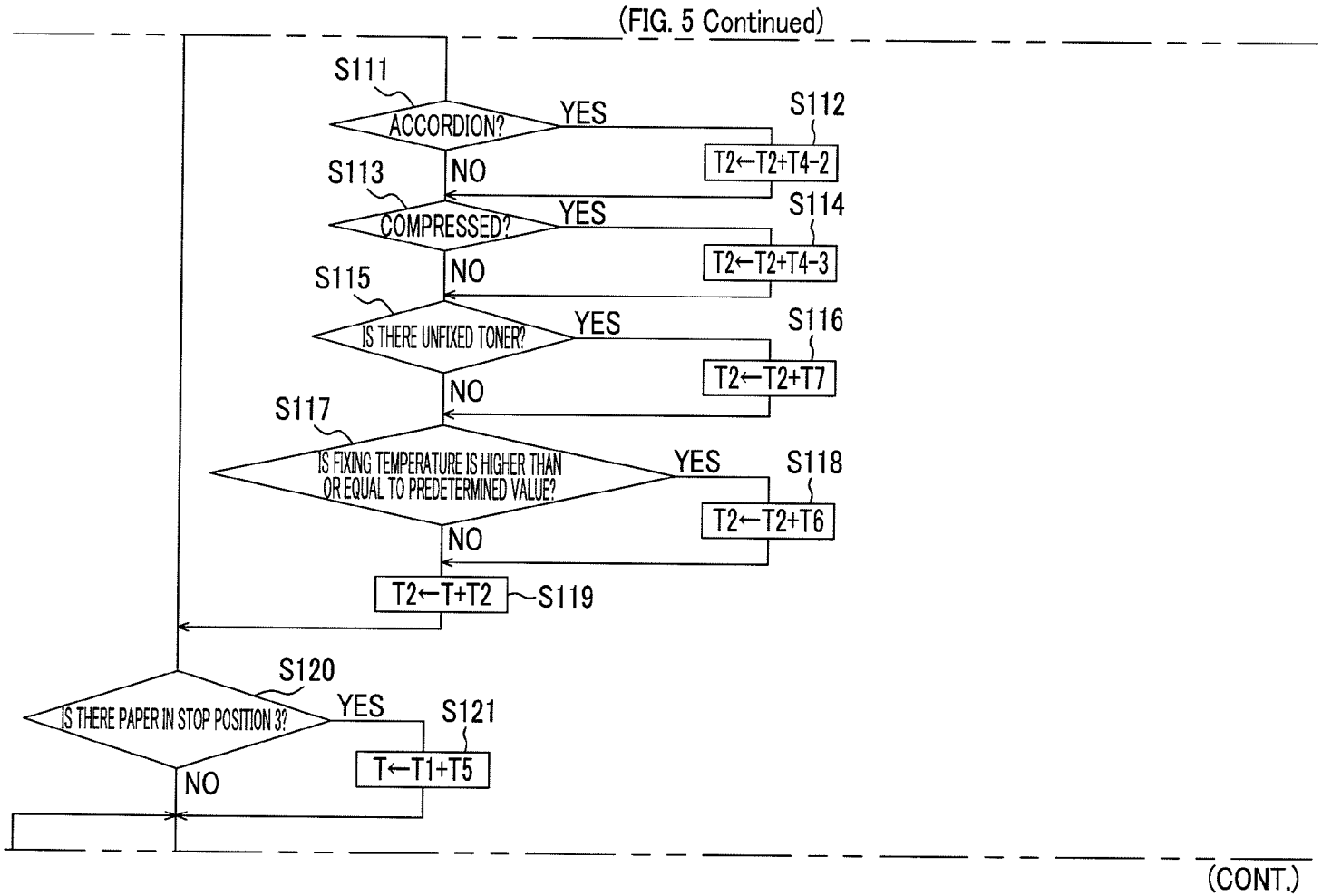
(FIG. 5 Continued)
S111
ACCORDION?
YES
NO
S112
T2←T2+T4-2
S113
COMPRESSED?
YES
NO
S114
T2←T2+T4-3
S115
IS THERE UNFIXED TONER?
YES
NO
S116
T2←T2+T7
S117
IS FIXING TEMPERATURE IS HIGHER THAN OR EQUAL TO PREDETERMINED VALUE?
YES
NO
S118
T2←T2+T6
S119
T2←T+T2
S120
IS THERE PAPER IN STOP POSITION 3?
YES
NO
S121
T←T1+T5
(CONT.)

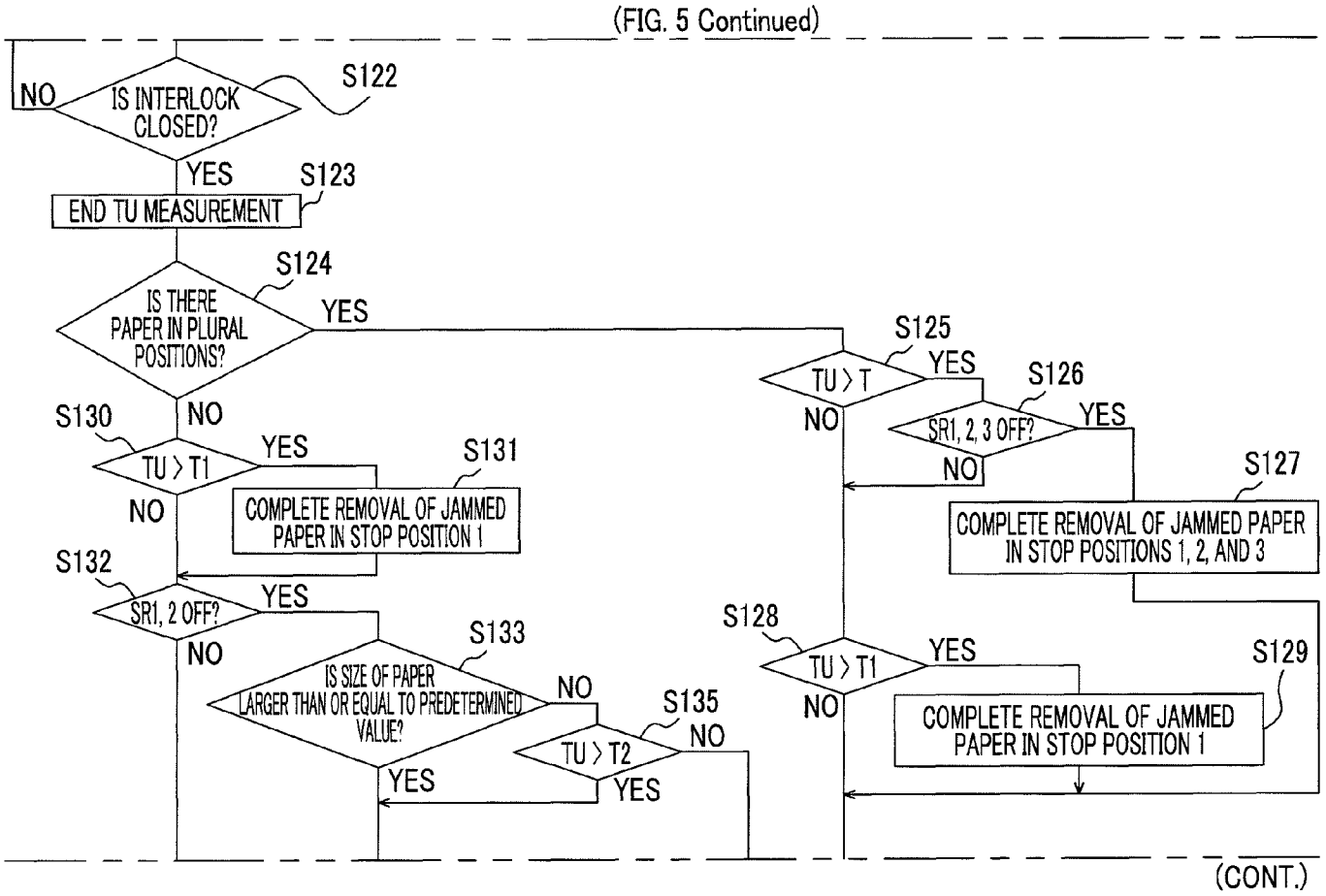
(FIG. 5 Continued)
S122
IS INTERLOCK CLOSED?
YES
NO
S123
END TU MEASUREMENT
S124
IS THERE PAPER IN PLURAL POSITIONS?
YES
NO
S125
TU > T
YES
NO
S126
SR1, 2, 3 OFF?
YES
NO
S127
COMPLETE REMOVAL OF JAMMED PAPER IN STOP POSITIONS 1, 2, AND 3
S128
TU > T1
YES
NO
S129
COMPLETE REMOVAL OF JAMMED PAPER IN STOP POSITION 1
S130
TU > T1
YES
NO
S131
COMPLETE REMOVAL OF JAMMED PAPER IN STOP POSITION 1
S132
SR1, 2 OFF?
YES
NO
S133
IS SIZE OF PAPER LARGER THAN OR EQUAL TO PREDETERMINED VALUE?
YES
NO
S135
TU > T2
YES
NO
(CONT.)

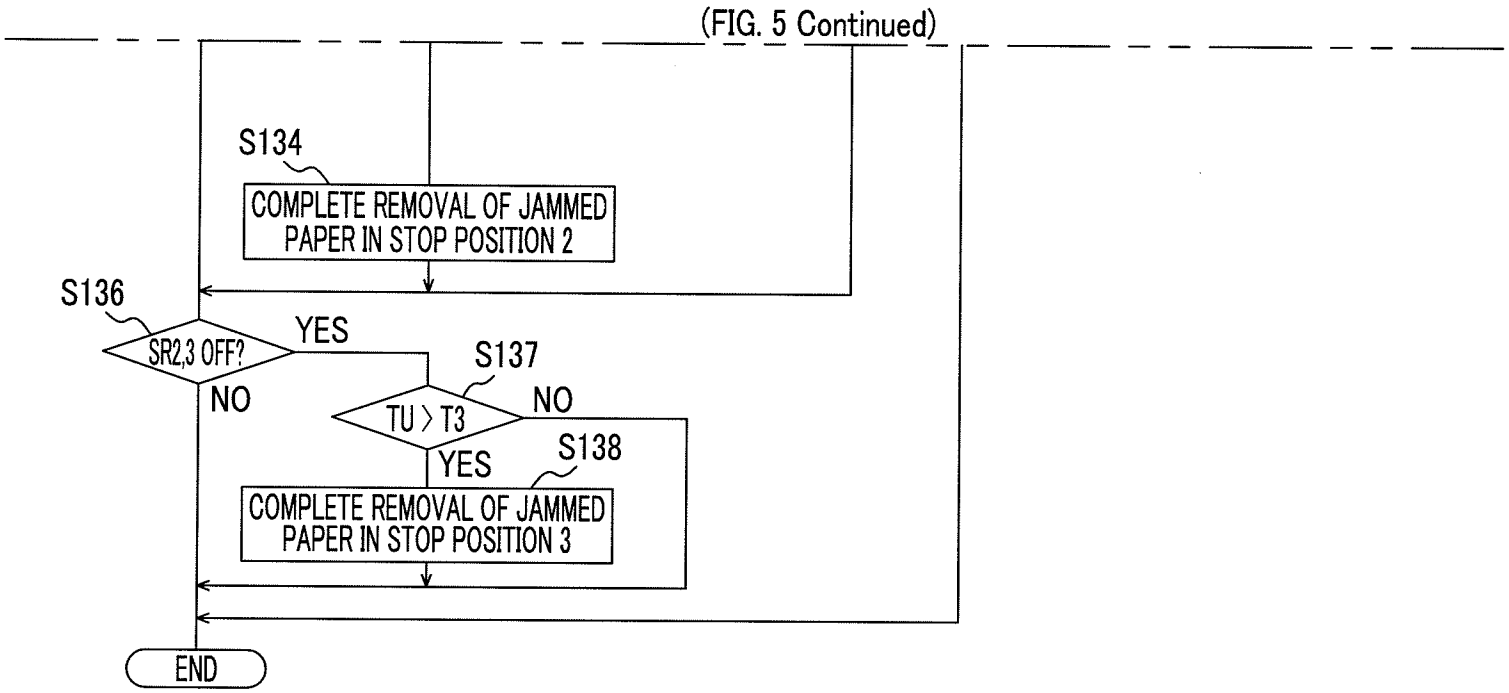
(FIG. 5 Continued)
S134
COMPLETE REMOVAL OF JAMMED PAPER IN STOP POSITION 2
S136
SR2,3 OFF?
YES
NO
S137
TU > T3
NO
YES
S138
COMPLETE REMOVAL OF JAMMED PAPER IN STOP POSITION 3
END

INFORMATION PROCESSING DEVICE, AND NON-TRANSITORY COMPUTER READABLE MEDIUM STORING PROGRAM

CROSS-REFERENCE TO RELATED APPLICATIONS

This application is based on and claims priority under 35 USC 119 from Japanese Patent Application No. 2014-062829 filed Mar. 26, 2014.

BACKGROUND

Technical Field

The present invention relates to an information processing device, and a non-transitory computer readable medium storing a program.

SUMMARY

According to an aspect of the invention, there is provided an information processing device, including:

an opening and closing detection unit that detects opening and closing of an opening and closing door which exposes a paper transporting passage for transporting paper;

a paper jam detection unit that detects a paper jam in the paper transporting passage;

a time measurement unit that measures a time when the paper jam is detected and opening of the opening and closing door is detected; and a control unit that controls the paper jam to be continued when a time measured by the time measurement unit is shorter than a predetermined time in case of detecting closing of the opening and closing door.

BRIEF DESCRIPTION OF THE DRAWINGS

Exemplary embodiments of the present invention will be described in detail based on the following figures, wherein.

DETAILED DESCRIPTION

Figure 1:
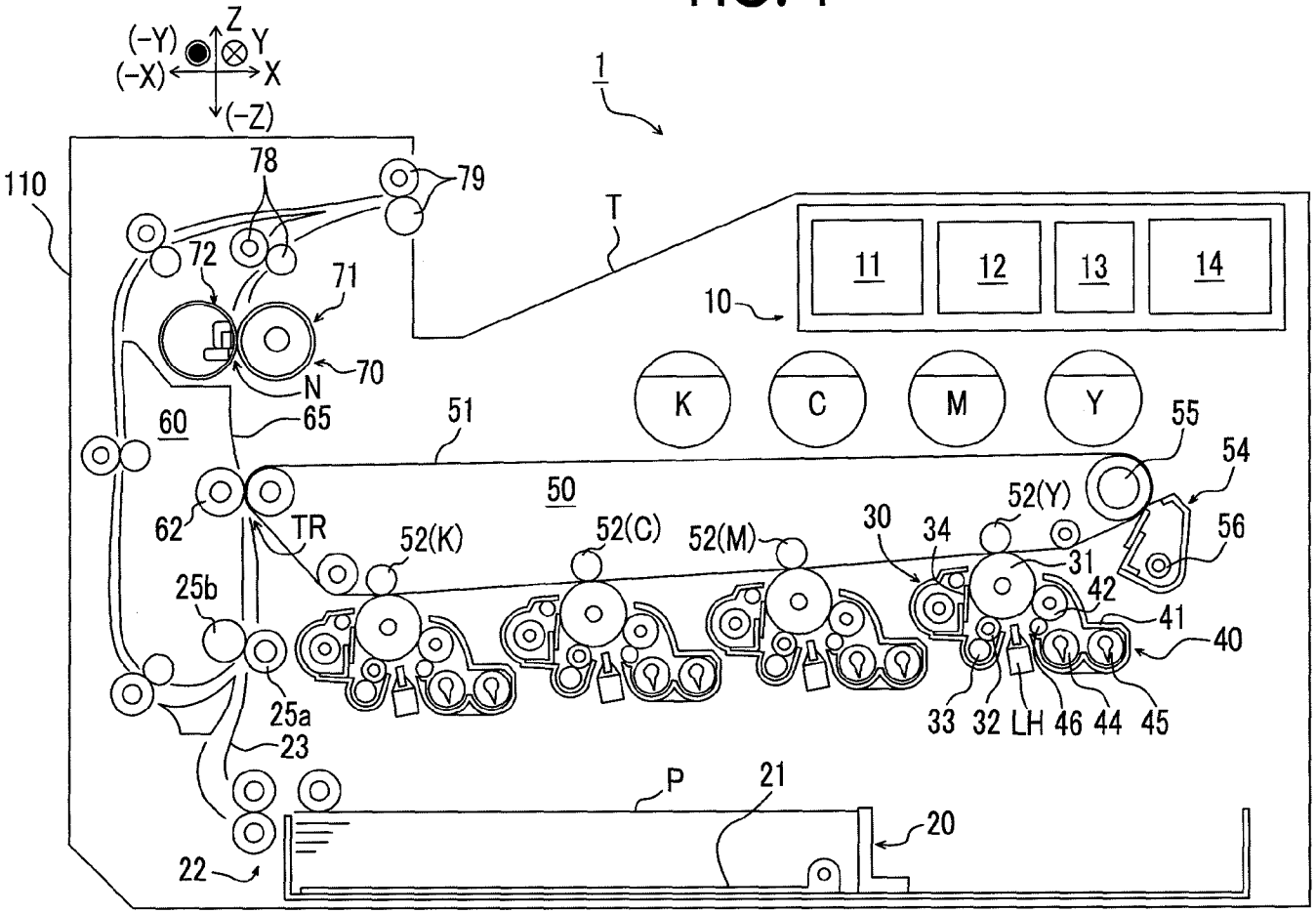
FIG. 1 is a schematic vertical sectional view illustrating an inner configuration of an image forming apparatus.

Next, hereinafter, the present invention will be more specifically described by exemplary embodiments and specific examples with reference to the drawings, but the present invention is not limited to the exemplary embodiments and the specific examples.

In addition, hereinafter, in the description with reference to the drawings, it is noted that the drawings are schematic diagrams, and the ratio of each dimension or the like is different from an actual value, and an illustration of a part other than the part which is necessary for the description will be properly omitted for the sake of easy understanding.

Furthermore, for the sake of easy understanding of the following description, a front-back direction is an X-axial direction, a right-left direction is a Y-axial direction, and an up-down direction is a Z-axial direction, in the drawings.

(1) Entire Configuration and Operation of Image Forming Apparatus

FIG. 1 is a schematic vertical sectional view illustrating an inner configuration of an image forming apparatus 1 as an example of an information processing device according to this exemplary embodiment.

Hereinafter, an entire configuration and an operation of the image forming apparatus 1 will be described with reference to the drawings.

Figure 2:
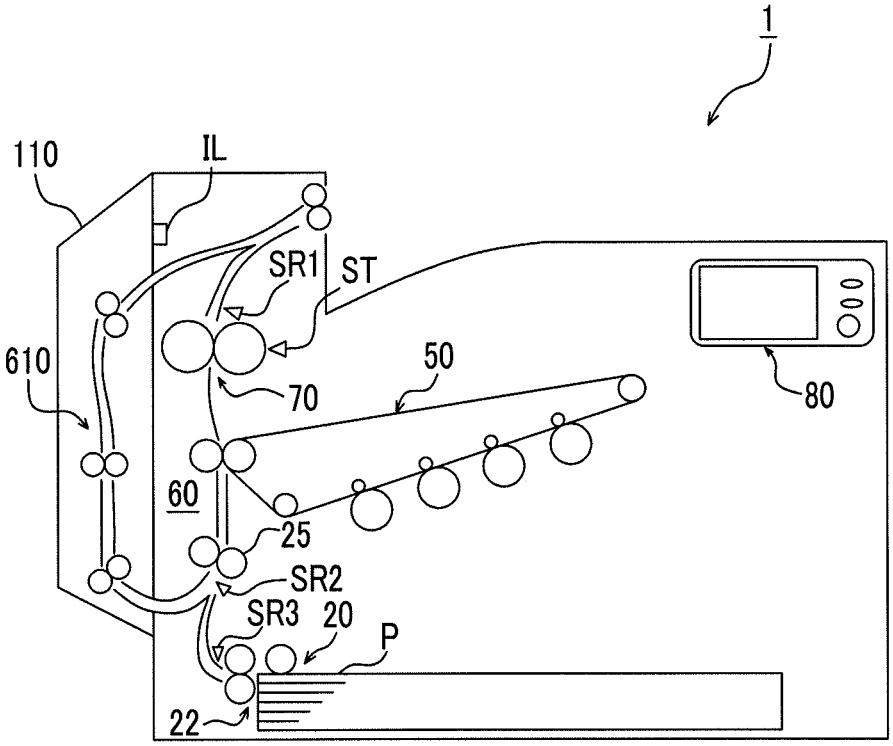
FIG. 2 is a schematic diagram of an entire configuration including a paper transport section of the image forming apparatus.
Figure 3:
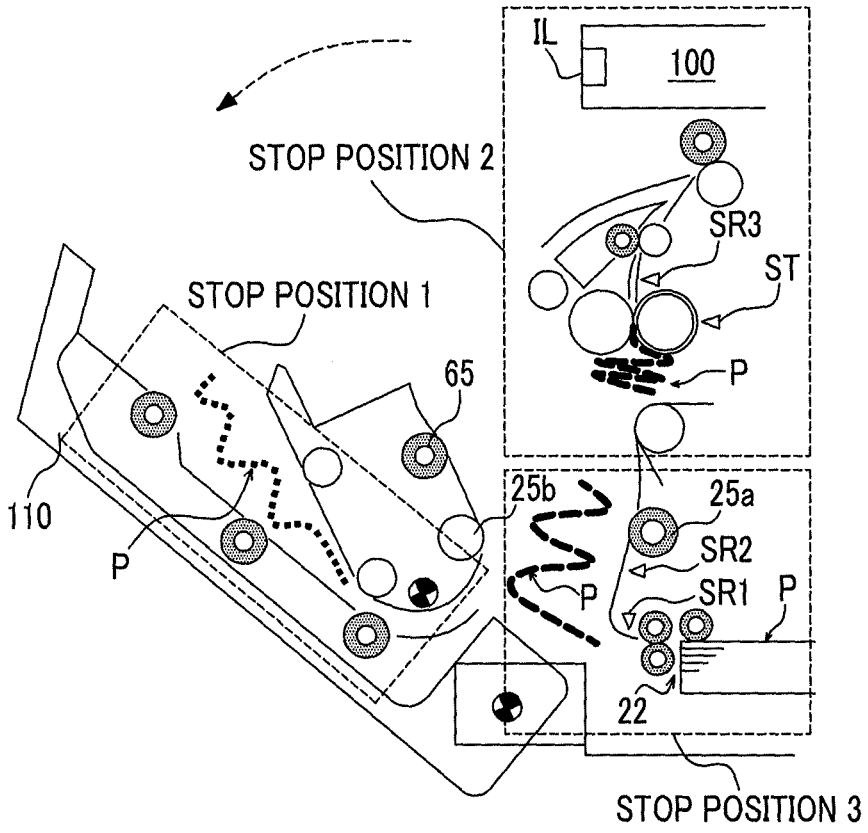
FIG. 3 is a schematic diagram illustrating remaining paper at the time of opening the paper transport section of the image forming apparatus when a paper jam occurs.

The image forming apparatus 1 includes a control device 10, a paper feeder 20, photoreceptor units 30, developing units 40, a transfer unit 50, a paper transport unit 60, a fixing unit 70, and a manipulation information section 80 (illustrated in FIG. 2), and the like in an housing 100 (illustrated in FIG. 3). On an upper surface of the image forming apparatus 1 (a Z direction), a discharge tray section T for discharging and containing paper on which an image is recorded, is formed. Further, on a side surface of the image forming apparatus 1 (a −X direction), an opening and closing door 110 (illustrated in FIG. 2) which opens an inner portion of the image forming apparatus 1 when paper removing at the time of a paper jam or checking is performed, is rotatably supported.

The control device 10 includes an image forming apparatus control section 11 for controlling the operation of the image forming apparatus 1, a controller section 12 for preparing image data according to a request of a printing process, an exposure control section 13 for controlling lighting of an exposure head LH, a power-supply device 14, and the like. The power-supply device 14 applies a high-voltage to a charging roller 32, a developing roller 42, a primary transfer roller 52, a secondary transfer roller 62, and the like (described later), and supplies electric power to the exposure head LH, the paper feeder 20, the fixing unit 70, each provided sensor, and the like.

The controller section 12 converts printing information input from an external information transmitting apparatus (for example, a personal computer or the like) to image information for forming a latent image, and outputs a driving signal to the exposure head LH at a predetermined timing. The exposure head LH of this exemplary embodiment is configured by an LED head in which plural light emitting elements (Light Emitting Diode: LED) are linearly arranged along a main scanning direction.

The manipulation information section 80 is configured by combining a liquid crystal display panel, various manipulation buttons, a touch panel, and the like, and a user of the image forming apparatus 1 inputs various settings or instructions through the manipulation information section 80. In addition, various information items are displayed to the user of the image forming apparatus 1 through the liquid crystal display panel.

In a bottom portion of the image forming apparatus 1, the paper feeder 20 is disposed. The paper feeder 20 includes a paper stacking plate 21, and paper P as plural recording mediums is stacked on an upper surface of the paper stacking plate 21. The paper P which is stacked on the paper stacking plate 21, and of which a position in a width direction is determined by a regulation plate (not illustrated) is pulled out one by one from an upper side to a front side (the −X direction) by a paper pulling out section 22, and then transported to a nip portion of a pair of resist rollers 25 which includes a driving roller 25*a* and a driven roller 25*b* through a paper guide 23.

The photoreceptor units 30 are respectively disposed in an upper portion (a Z direction) of the paper feeder 20 in parallel, and include photoreceptor drums 31 as a rotating image carrier. Along a rotating direction of the photoreceptor drum 31, the charging roller 32, the exposure head LH, the developing unit 40, the primary transfer roller 52, and a cleaning blade 34 are arranged. In the charging roller 32, a cleaning roller 33 for cleaning a surface of the charging roller 32 is arranged to face the charging roller 32 and to come in contact with the charging roller 32.

The developing unit 40 includes a developing housing 41 which contains a developer in an inner portion. In the developing housing 41, a developing roller 42 is arranged to face the photoreceptor drum 31, and in an inclined lower portion of a back surface side of the developing roller 42, a pair of augers 44 and 45 for transporting the developer to the developing roller 42 side with stirring are disposed. A layer regulation member 46 for regulating a layer thickness of the developer is arranged close to the developing roller 42.

The respective developing units 40 include an approximately similar configuration, except that the developer contained in the developing housing 41, and the developing units 40 form toner images of yellow (Y), magenta (M), cyan (C), and black (K), respectively.

A surface of the rotating photoreceptor drum 31 is charged by the charging roller 32, and an electrostatic latent image is formed by latent image-forming light emitted from the exposure head LH. The electrostatic latent image formed on the photoreceptor drum 31 is developed by the developing roller 42 as a toner image.

The transfer unit 50 includes an intermediate transfer belt 51 to which each colored toner image formed on the photoreceptor drum 31 of each of the photoreceptor units 30 is multiply transferred, and the primary transfer roller 52 which sequentially transfers (a primary transfer) each of the colored toner images formed by each of the photoreceptor units 30 to the intermediate transfer belt 51. Further, the transfer unit 50 includes an intermediate transfer belt cleaner 54 which removes a residual toner attached on the intermediate transfer belt 51.

The paper transport unit 60 includes the driven roller 25*b* of the pair of resist rollers 25 which correct a posture of the paper P fed from the paper feeder 20 and sends the paper P to a secondary transfer section TR according to a timing for performing a secondary transfer, and the secondary transfer roller 62 which transfers (the secondary transfer) each of the colored toner images which are transferred and superposed on the intermediate transfer belt 51 to the paper P as the recording medium at once. In addition, the paper P on which the transferred toner image is maintained is guided to a fixing nip portion N of the fixing unit 70 through a transport guide 65.

Each of the colored toner images formed on the photoreceptor drum 31 of each of the photoreceptor units 30 is sequentially and electrostatically transferred (the primary transfer) to the intermediate transfer belt 51 by the primary transfer roller 52 to which a predetermined transfer voltage is applied from the power-supply device 14 or the like controlled by the image forming apparatus control section 11, and a superposed toner image in which each color toner is superposed is formed.

The superposed toner image on the intermediate transfer belt 51 is transported to the secondary transfer section TR according to movement of the intermediate transfer belt 51. When the superposed toner image is transported to the secondary transfer section TR, according to this timing, the paper P is supplied to the secondary transfer section TR from the pair of resist rollers 25.

Then, a predetermined transfer voltage is applied to the secondary transfer roller 62 from the power-supply device 14 or the like controlled by the image forming apparatus control section 11, multiple toner images on the intermediate transfer belt 51 is transferred to the paper P which is sent from the pair of resist rollers 25 and guided by the paper guide 23 at once.

The residual toner on the surface of the photoreceptor drum 31 is removed by the cleaning blade 34, and recovered in a waste toner recovery container (not illustrated). The surface of the photoreceptor drum 31 is charged again by the charging roller 32. Furthermore, a residual substance attached to the charging roller 32, which is not able to be removed by the cleaning blade 34 is captured to the surface of the cleaning roller 33 which comes in contact with the charging roller 32 and rotates, and thus is accumulated.

The fixing unit 70 includes a heating module 71 and pressing module 72, and the fixing nip portion N (a fixing region) is formed by a pressure bonding region of the heating module 71 and the pressing module 72.

In the secondary transfer section TR, the paper P to which the toner image is transferred is transported to the fixing unit 70 through the transport guide 65 in a state where the toner image is not fixed. The toner image is fixed to the paper P transported to the fixing unit 70 by an action of pressure bonding and heating by a pair of heating module 71 and pressing module 72.

The paper P on which the fixed toner image is formed, is discharged to the discharge tray section T on the upper surface of the image forming apparatus 1 from a pair of discharge rollers 79 through a pair of transport rollers 78. In addition, at the time of performing duplex printing, when a trailing edge of the paper P of which the surface is fixed passes through the pair of transport rollers 78, the pair of discharge rollers 79 is reversely driven, and the paper P is transported to the pair of resist rollers 25 from a reverse transporting passage formed in the opening and closing door 110, and thus the image is formed on a back surface.

(2) Configuration and Operation of Paper Transport Section

FIG. 2 is a schematic diagram of an entire configuration including a paper transport section of the image forming apparatus 1, and FIG. 3 is a schematic diagram illustrating remaining paper at the time of opening the paper transport section of the image forming apparatus 1 when a paper jam occurs.

Hereinafter, a configuration of the paper transport section of the image forming apparatus 1 and an operation thereof at the time of the paper jam will be described with reference to the drawings.

(2.1) Configuration of Paper Transport Section

The paper transport section of the image forming apparatus 1 includes the paper feeder 20, the transfer unit 50, the paper transport unit 60, and the fixing unit 70.

In the paper feeder 20, a sensor SR3 for detecting a sending of the paper P pulled out by the paper pulling out section 22 is arranged.

In addition, on an upstream side of the pair of resist rollers 25, a sensor SR2 for detecting the paper P fed from the paper feeder 20 and the paper P transported through a duplex unit portion 610 is arranged, and on a downstream side of the fixing nip portion N of the fixing unit 70, a sensor SR1 for detecting a discharge of the fixed paper P is arranged.

Further, in the fixing unit 70, a temperature sensor ST for detecting a temperature of the heating module 71 is arranged.

In the housing 100 of the image forming apparatus 1, an interlock switch IL is disposed.

The interlock switch IL blocks the electric power from the power-supply device 14 when the opening and closing door 110 opens in order to remove the jammed paper P at the time of the paper jam occurring (hereinafter, simply referred to as "jam").

(2.2) Manipulation at the time of Paper Jam When the paper jam occurs in the image forming apparatus 1, the image forming apparatus control section 11 displays information to the effect that the paper jam occurs on the manipulation information section 80 based on detection signals from the sensors SR1, SR2, and SR3 corresponding to each paper jam position, and the image forming operation is paused.

Then, the user opens the opening and closing door 110 and removes the jammed paper P based on information displayed on the manipulation information section 80.

As illustrated in FIG. 3, the paper jam may occur in each position in a paper transporting path, and thus the user opens the opening and closing door 110 and removes the jammed paper P in the paper transporting passage.

As the paper jam position, Stop Position 3 which is a region from the paper pulling out section 22 to the pair of resist rollers 25, Stop Position 2 which is a region where the paper P is guided to the fixing unit 70 after the secondary transfer and a region where the paper P is discharged from the fixing unit 70, and Stop Position 1 which is a reverse transportation region where the paper P is reversed for the duplex printing and transported again to the pair of resist rollers 25 are included.

When the user removes the jammed paper P in each of the Stop Positions 1, 2, and 3, manipulations such as opening the opening and closing door 110, recognizing the jammed paper P in each of the Stop Positions 1, 2, and 3, removing the recognized jammed paper P, and closing the opening and closing door 110 are continuously performed. For this reason, it is assumed that a predetermined period of time is required in order to complete a series of jam processing manipulations.

Then, in the image forming apparatus 1, when the jam processing manipulation is performed, and the interlock switch IL is in a closed state by closing the opening and closing door 110, the image forming operation is restarted.

In addition, when another jammed paper P comes in contact with the sensors SR1, SR2, and SR3 and is suspended even after performing the jam processing manipulation, it is determined that the jammed paper P remains in the paper transporting passage at the time that the opening and closing door 110 is closed and the interlock switch IL is in the closed state, and the image forming operation is not restarted.

On the other hand, in the image forming apparatus 1, when another jammed paper P remains in a position which is not detected by the sensors SR1, SR2, and SR3, for example, a position between the sensor SR2 and the sensor SR3, or a position in the reverse transporting passage even after performing the jam processing manipulation, the image forming operation is restarted at the time that the opening and closing door 110 is closed and the interlock switch IL is in the closed state, and thus may be in a paper jam state again.

As a result, the user is required to perform the jam processing manipulation again, and thus a downtime of the image forming apparatus 1 may be longer.

(3) Operation at the Time of Paper Jam

Figure 4:
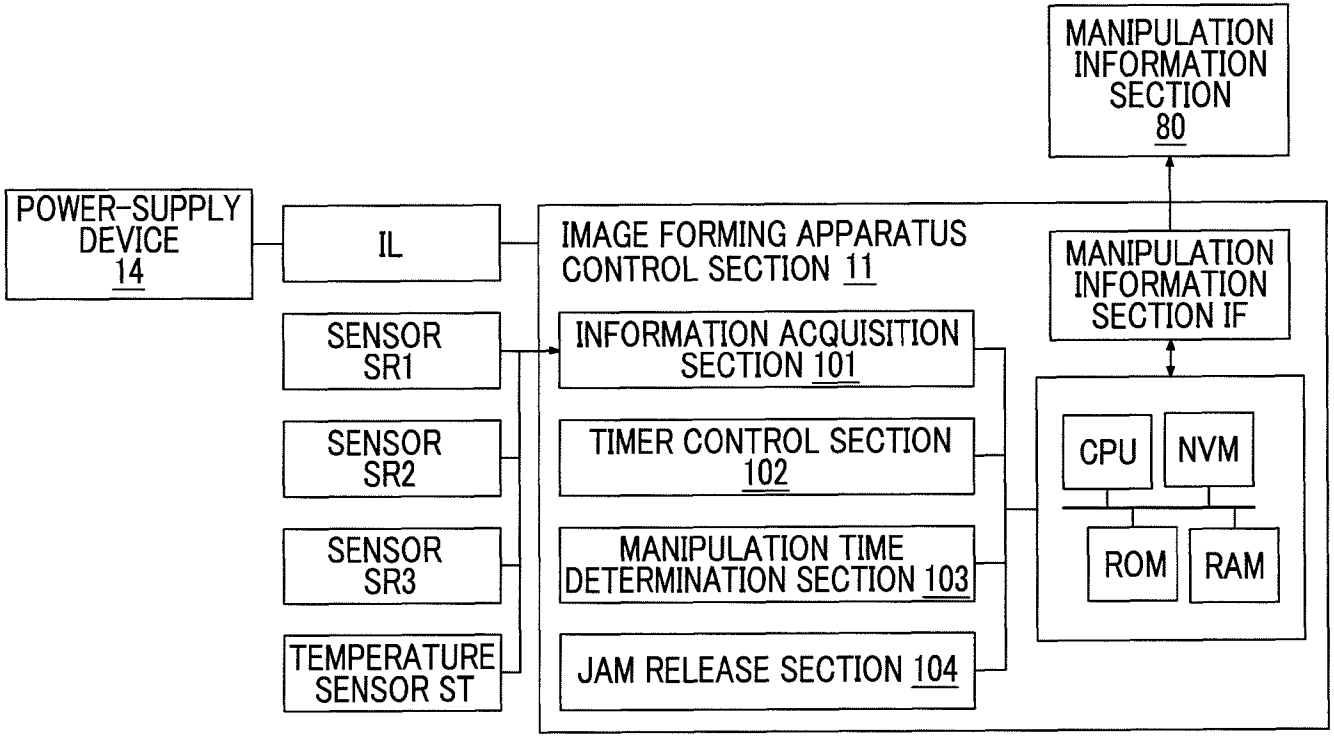
FIG. 4 is a schematic block diagram of a main part for performing a jam processing operation of the image forming apparatus.
Figure 5:
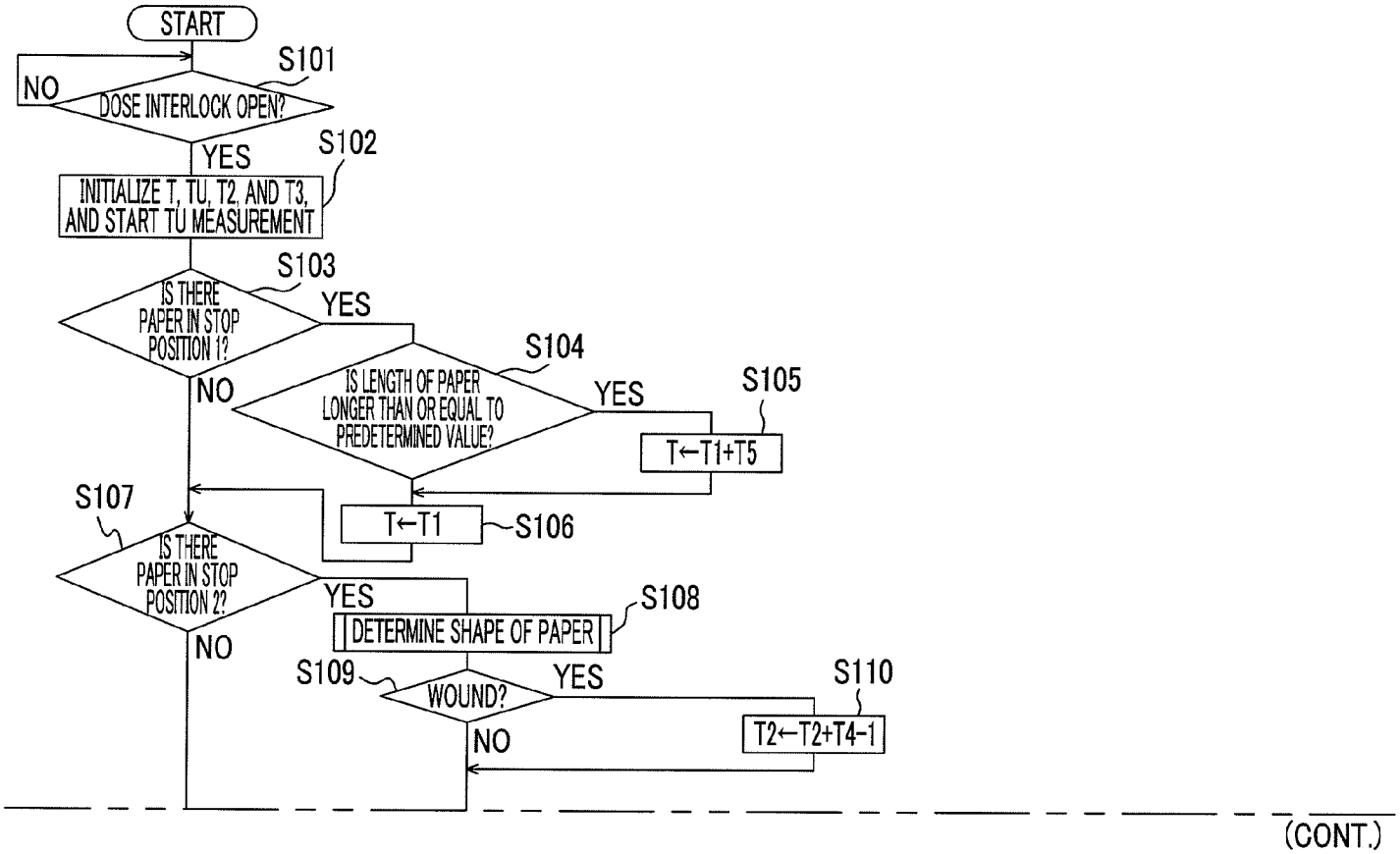
FIG. 5 is a flowchart illustrating an operation flow at the time of the jam process of the image forming apparatus.
Figure 6:
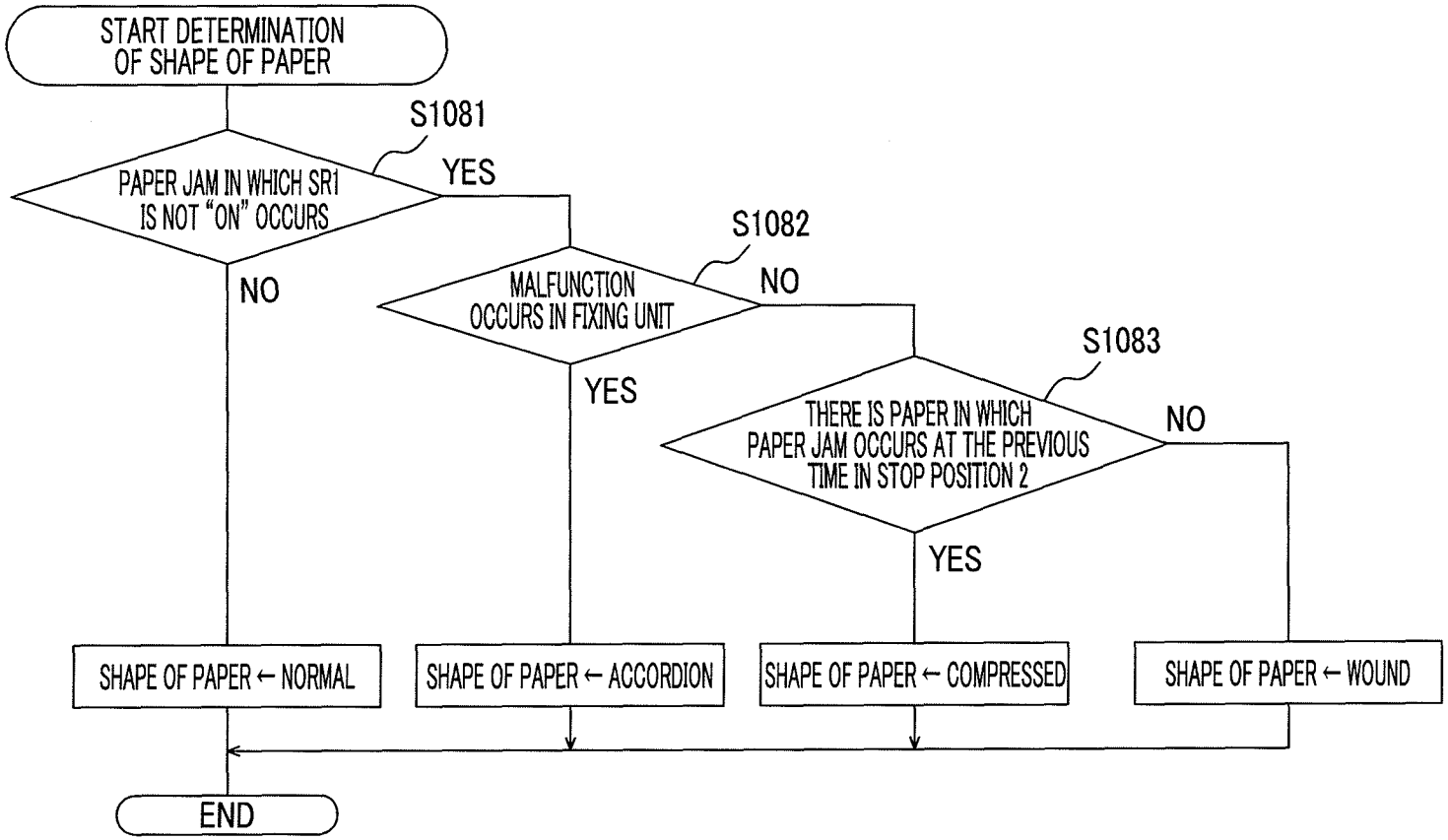
FIG. 6 is a flowchart illustrating an operation flow for determining a shape of paper when the paper jam occurs in Stop Position 2.
Figure 7:
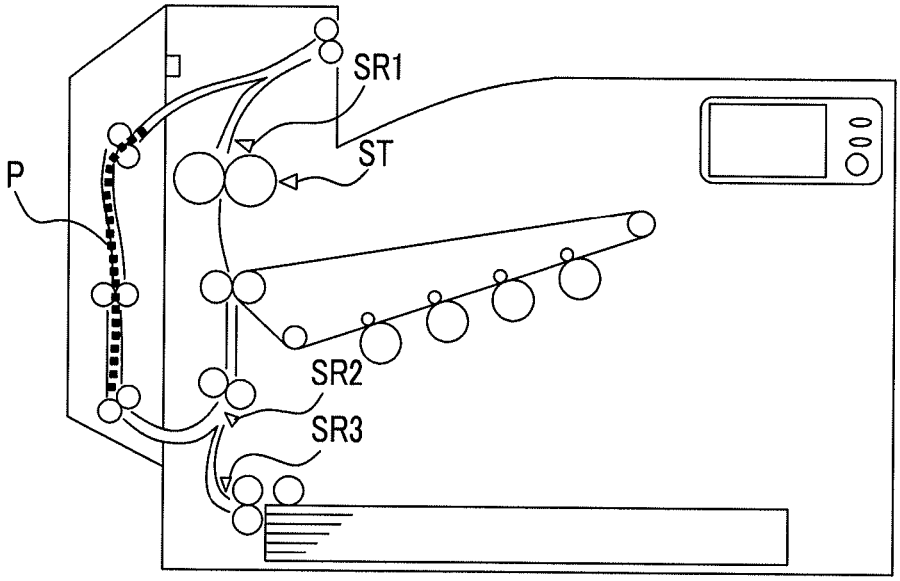
FIG. 7 is a schematic diagram illustrating a state of a paper transporting passage in which a jammed paper is suspended in Stop Position 1.
Figure 8A:
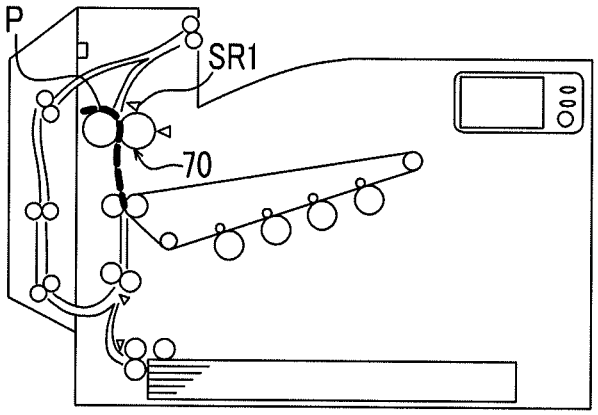
FIGS. 8A, 8B, and 8C are schematic diagrams illustrating a state of the paper transporting passage in which a jammed paper is suspended in Stop Position 2.
Figure 8B:
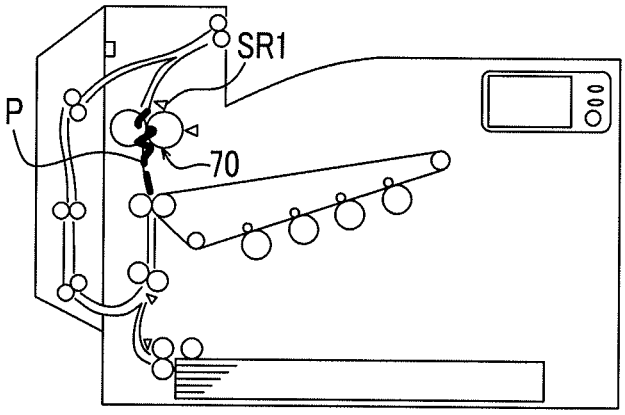
Figure 8C:
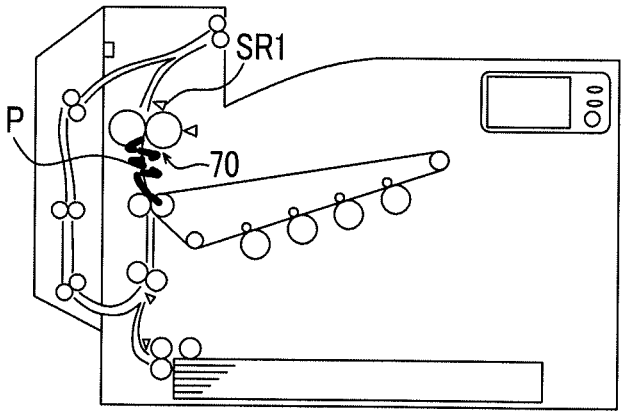
Figure 9:
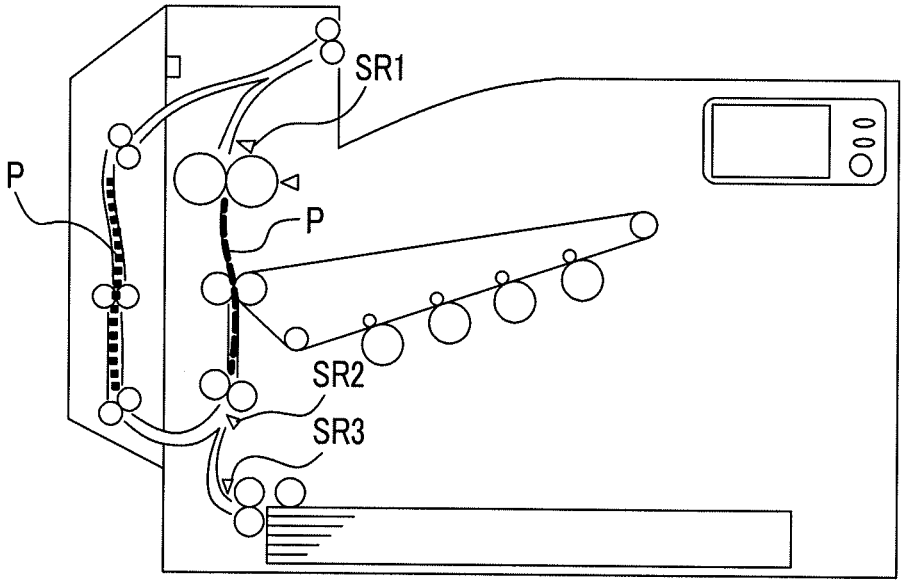
FIG. 9 is a schematic diagram illustrating a state of the paper transporting passage in which jammed papers are suspended in plural positions.
Figure 10A:
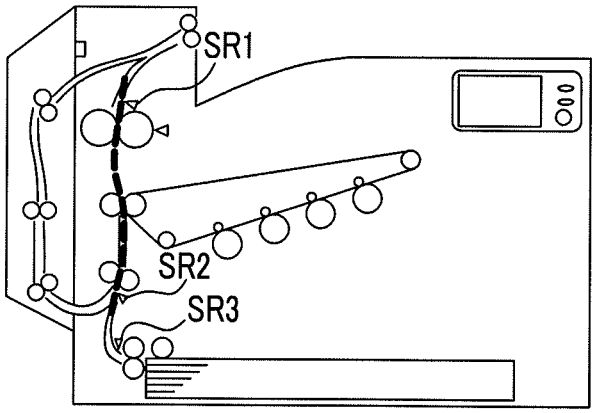
FIGS. 10A and 10B are schematic diagrams illustrating a state of the paper transporting passage in which jammed paper having different sizes is suspended.
Figure 10B:
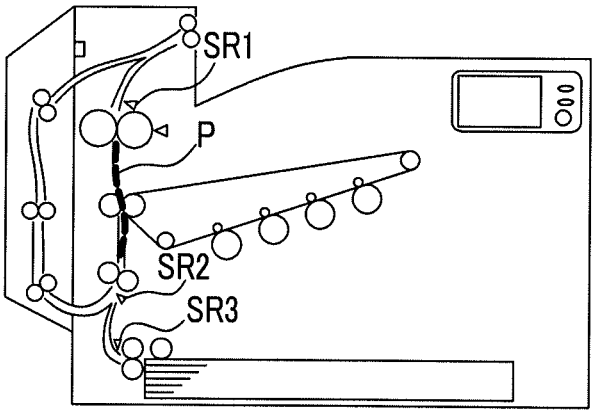

FIG. 4 is a schematic block diagram of a main part for performing a jam processing operation of the image forming apparatus 1, FIG. 5 is a flowchart illustrating an operation flow at the time of the jam process of the image forming apparatus 1, FIG. 6 is a flowchart illustrating an operation flow for determining a shape of paper when the paper jam occurs in Stop Position 2, FIG. 7 is a schematic diagram illustrating a state of a paper transporting passage in which jammed paper P is suspended in Stop Position 1, FIGS. 8A, 8B, and 8C are schematic diagrams illustrating a state of the paper transporting passage in which the jammed paper P is suspended in Stop Position 2, FIG. 9 is a schematic diagram illustrating a state of the paper transporting passage in which the jammed paper P is suspended in plural positions, and FIGS. 10A and 10B are schematic diagrams illustrating a state of the paper transporting passage in which the jammed paper P having different sizes is suspended.

Hereinafter, a jam release operation at the time of the paper jam occurring in the image forming apparatus 1 according to this embodiment will be described with reference to the drawings.

As illustrated in FIG. 4, the image forming apparatus control section 11 includes an information acquisition section 101 for acquiring a detection signal from the interlock switch IL as an example of an opening and closing detection unit of the opening and closing door 110, the sensors SR1, SR2, and SR3 as an example of a paper jam detection unit for detecting the paper jam in different positions in the paper transporting passage, and the temperature sensor ST as an example of a temperature detection unit of the image forming section, a timer control section 102 as an example of a time measurement unit for measuring a manipulation time of the jam processing manipulation executed by the user when it is detected that the opening and closing door 110 opens by the interlock switch IL, a manipulation time determination section 103 for determining whether or not the manipulation time measured by the timer control section 102 is a predetermined time, and a jam release section 104 for completing a paper jam process at the time of determining that the manipulation of the user is completed by the manipulation time determination section 103.

In the image forming apparatus 1 according to this exemplary embodiment, when it is detected that the opening and closing door 110 opens by the interlock switch IL, the timer control section 102 measures a manipulation time TU until the interlock switch IL is closed.

Then, when it is determined that the measured manipulation time TU is shorter than a predetermined time T, it is determined that the jammed paper P is not removed, and the jam release section 104 displays information to the effect that the jammed paper P is not removed on the manipulation information section 80, and thus the image forming operation is not restarted. For this reason, another paper jam is avoided, and thus the downtime of the image forming apparatus 1 does not increase.

Hereinafter, in the description of the jam release operation at the time of the paper jam occurring, each time is set to the predetermined time T required for the jam processing, the measured manipulation time TU, a predetermined time T1 required for the jam processing when the paper jam occurs in Stop Position 1, a predetermined time T2 required for the jam processing when the paper jam occurs in Stop Position 2, and a predetermined time T3 required for the jam processing when the paper jam occurs in Stop Position 3.

Furthermore, as illustrated in FIG. 3, in each of the Stop Positions 1, 2, and 3, the manipulation time required for removing the jammed paper P by the user is assumed to form a relationship of T1<T2<T3 according to ease of access of the user with respect to the jammed paper P.

In the image forming apparatus 1, when the paper jam occurs, the image forming apparatus 1 suspends the image forming operation, and displays information to the effect that the paper jam occurs on the manipulation information section 80.

When the paper transporting path is exposed by opening the opening and closing door 110 in order for the user to remove the jammed paper P, it is determined whether or not the interlock switch IL is in an open state (open) (S101).

Then, the timer control section 102 initializes each of the times T, TU, T1, T2, and T3 which are stored in a nonvolatile memory (NVM), and starts a measurement of the manipulation time TU by the user (S102). Next, it is determined whether or not the jammed paper P is in Stop Position 1 (S103), and when it is determined that the jammed paper P is in Stop Position 1 (S103; Yes), it is further determined whether or not the length of the jammed paper P is longer than or equal to a predetermined length (S104, refer to FIG. 7).

In Stop Position 1, the jammed paper is transported by being interposed between plural transport rollers as illustrated in FIG. 3, and thus when the length of the paper is long, a time T5 which is a predetermined time is added to the time T1, and the time T is set to the time T1+T5 (S105). Furthermore, when the length of the paper is shorter than a predetermined length (S104; No), the predetermined time T required for the jam processing is set to the time T1 (S106).

Next, when it is determined whether or not the jammed paper P is in Stop Position 2 (S107), and when it is determined that the jammed paper P is in Stop Position 2 (S107; Yes), the shape of the paper which is a jammed state of the jammed paper P is further determined (S108).

When it is determined that the jammed paper P is in Stop Position 2 (S107; Yes), in order to determine the shape of the paper of the jammed paper P, it is determined whether or not the paper jam in which the sensor SR1 is not "ON" occurs (S1081), and when it is determined that the paper jam in which the sensor SR1 is not "ON" occurs (S1081; Yes), it is further determined whether or not malfunction occurs in the fixing unit 70 (S1082).

As a result, when it is determined that the malfunction does not occur in the fixing unit 70 (S1082; No), it is determined whether or not the jammed paper P in which the paper jam occurs at the previous time is in Stop Position 2 (S1083), and when it is determined that the jammed paper P in which the paper jam occurs at the previous time is not in Stop Position 2 (S1083; No), it is determined that the jammed paper P is wound around the heating module 71 or the pressing module 72 of the fixing unit 70 (S109; Yes, refer to FIG. 8A).

When it is determined that the jammed paper P in which the paper jam occurs at the previous time is in Stop Position 2 (S1083; Yes), it is determined that the jammed paper P in which the paper jam occurs at the previous time is not sufficiently removed, and reprinted paper P irrupts into a piece of the paper which remains in the fixing nip, and thus the piece of the remaining paper and the reprinted paper P are deformed to be in a compressed state (S113; Yes, refer to FIG. 8B).

When it is determined that the malfunction occurs in the fixing unit 70 (S1082; Yes), for example, the rotation of the heating module 71 and the pressing module 72 of the fixing unit 70 is suspended, and the paper P is pressed into the fixing nip portion N of the fixing unit 70 from the secondary transfer roller 62, and thus it is determined that the paper P is deformed to be in an accordion state (S111; Yes, refer to FIG. 8C).

Then, when the shape of the paper is in a wound state based on each determination of the shape of the paper (S109; Yes), a time T4−1 which is a predetermined time is added to the time T2 (S110), and when the shape of the paper is in the accordion state (S111; Yes), a time T4−2 which is a predetermined time is added to the time T2 (S112). In addition, when it is determined that the shape of the paper is in the compressed state (S113; Yes), a time T4−3 which is a predetermined time is added to the time T2 (S112).

Next, it is determined whether or not there is an unfixed toner in the paper on which the image is recorded (S115), and when it is determined that there is the unfixed toner in the paper (S115; Yes), it is assumed that the user performs a rigorous manipulation in order to prevent the image forming apparatus 1 from being contaminated by the unfixed toner, and thus a time T7 which is a predetermined time is added to the time T2 (S116).

Further, it is determined whether or not the temperature of the heating module 71 detected by the temperature sensor ST is higher than or equal to a predetermined temperature (S117), and when the temperature of the heating module 71 is higher than or equal to a predetermined temperature (S117; Yes), it is assumed that the user performs the rigorous manipulation, and thus a time T6 which is a predetermined time is added to the time T2 (S118).

Then, the time T2 which is calculated according to a state of the jammed paper P in Stop Position 2, described above, is added to the time T.

Next, it is determined whether or not the jammed paper P is in Stop Position 3 (S120), and when it is determined that the jammed paper P is in Stop Position 3 (S120; Yes), the predetermined time T3 required for the jam processing when the paper jam occurs in Stop Position 3, is added to the predetermined time T required for the jam processing (S121).

Then, it is determined whether or not the interlock switch IL is in the closed state (close) (S122), and when it is confirmed that the interlock switch IL is closed (S122; Yes), the measurement of the manipulation time TU by the user is ended (S123).

Then, it is determined whether or not the jammed paper P is in plural stop positions (S124). When it is determined that the jammed paper P is in the plural positions such as the Stop Positions 1, 2, and 3 (S124; Yes, refer to FIG. 9), it is determined whether or not the manipulation time TU of which the measurement is ended in Step S123 is longer than the predetermined time T required for the jam processing (S125), and when the manipulation time TU is longer than the predetermined time T required for the jam processing (S125; Yes), it is further determined whether or not all of the sensors SR1, SR2, and SR3 in the paper transporting path are "OFF" (S126).

When all of the sensors SR1, SR2, and SR3 are "OFF" (S126; Yes), removal of the jammed paper P in the Stop Positions 1, 2, and 3 is completed (S127), and the image forming apparatus 1 is in a state where printing is restarted.

In Step S125, when it is determined that the manipulation time TU is shorter than the predetermined time T required for the jam processing (S125; No), it is further determined whether or not the manipulation time TU is longer than the predetermined time T1 required for jam processing in Stop Position 1 (S128), and when the manipulation time TU is longer than the predetermined time T1 required for jam processing in Stop Position 1 (S128; Yes), the removal of the jammed paper P in Stop Position 1 is completed (S129), and the image forming apparatus 1 is in the state where printing is restarted.

In Step S124, when it is determined that the jammed paper P is not in the plural positions such as the Stop Positions 1, 2, and 3 (S124; No), it is determined whether or not the manipulation time TU is longer than the predetermined time T1 required for the jam processing in Stop Position 1 (S130), and when the manipulation time TU is longer than the predetermined time T1 required for the jam processing in Stop Position 1 (S130; Yes), the removal of the jammed paper P in Stop Position 1 is completed (S131).

Then, it is further determined whether or not the sensors SR1 and SR2 are "OFF" in the paper transporting path (S132).

When the sensors SR1 and SR2 are "OFF" (S132; Yes), it is determined that a size of the paper is larger than or equal to a predetermined size (S133), and when the size of the paper is larger than or equal to a predetermined size in Stop Position 2 (refer to FIG. 10A), the sensor SR1 or the sensor SR2 is able to reliably detect the jammed paper P. Therefore, at the time that the interlock switch IL is closed, when the sensors SR1 and SR2 do not detect the jammed paper P, the removal of the jammed paper P in Stop Position 2 is completed (S134).

In Step S133, when the size of the paper is not larger than or equal to a predetermined size (S133; No, refer to FIG. 10B), it is determined whether or not the manipulation time TU is longer than the predetermined time T2 required for the jam processing in Stop Position 2 (S135), and when the manipulation time TU is longer than the predetermined time T2 required for the jam processing in Stop Position 2 (S135; Yes), the removal of the jammed paper P in Stop Position 2 is completed (S134).

When the sensors SR1 and SR2 are not "OFF" in Step S132 (S132; No), then it is determined whether or not the sensors SR2 and SR3 are "OFF" (S136). When the sensors SR2 and SR3 are "OFF" (S136; Yes), it is determined whether or not the manipulation time TU is longer than the predetermined time T3 required for the jam processing in Stop Position 3 (S137), and when the manipulation time TU is longer than the predetermined time T3 required for the jam processing in Stop Position 3 (S137; Yes), the removal of the jammed paper P in Stop Position 3 is completed (S138), and the image forming apparatus 1 is in the state where printing is restarted by removing the jammed paper P in the stop positions 1, 2, and 3.

The image forming apparatus 1 including the operation flow described above determines jam release based on a manipulation time of removing the jammed paper by the user, and thus it is possible to prevent handling of the jammed paper P from being missed, and to prevent suspending time of the apparatus from being increased due to a manipulation error of the user.

Furthermore, the predetermined time T described above is able to be suitably determined according to the size or the type, or the position of the jammed paper P which is paper jammed.

Specifically, in the fixing nip portion N of the fixing unit 70, since a nipping pressure is high, the stop position of the paper P is estimated from the time between when the paper P arrives at the fixing nip portion N of the fixing unit 70 and when the paper P is suspended, and the size of the paper, and the time T2 is able to be determined based on a distance that the paper P passes through the fixing nip portion N at the time of pulling out the paper P from the fixing nip portion N. In addition, the time T2 is also able to be determined by adding a basis weight of the paper P.

In addition, the time T2 is able to be suitably determined according to a wear state of the transport roller configuring the paper transporting passage. Specifically, since the nipping pressure of the pair of rollers decreases according to abrasion of the transport roller, the time T2 is able to be determined by estimating the abrasion state of the transport roller from the number of passed paper P.

When the paper jam occurs, the image forming apparatus 1 displays not only the information to the effect that the paper jam occurs, but also information to the effect that remaining paper P has to be removed on the manipulation information section 80 by estimating that any paper P is removed when the paper jam is detected in plural positions in the paper transporting passage and the jam processing is performed, and when the manipulation time TU measured by the timer control section 102 is longer than a predetermined time based on the position of the paper transporting passage, as illustrated in FIG. 9, and thus it is possible to set a priority order of removing the paper.

In addition, the image forming apparatus 1 displays information to the effect that the paper jam is not released on the manipulation information section 80 when the paper jam is detected again by the paper jam detection unit in the image forming operation which is restarted as the manipulation time TU measured by the timer control section 102 is longer than a predetermined time and as the paper jam is released.

Further, when the manipulation time TU measured by the timer control section 102 is shorter than a predetermined time, the image forming apparatus 1 displays the information to the effect that the paper jam is not released on the manipulation information section 80.

As a result, a condition of the image forming apparatus 1 is notified to the user, and it is possible to prevent the suspending time of the image forming apparatus 1 from being increased.

Herein, a case where a program is installed in advance is described as the exemplary embodiment, but the program may be provided by being stored in a storage medium such as a CD-ROM, and may be downloaded to a storage section in the image forming apparatus from a server apparatus or the like to which the Internet such as a telecommunication line is connected.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An information processing device, comprising:

an opening and closing detection unit that detects opening and closing of an opening and closing door which exposes a paper transporting passage for transporting paper;

a paper jam detection unit that detects a paper jam in the paper transporting passage;

a time measurement unit that measures a time when the paper jam is detected for opening of the opening and then closing door; and a control unit that controls a paper jam status to be continued when a time measured by the time measurement unit is shorter than a predetermined time that is deemed to be necessary for the opening and then closing of the opening and closing door for removal of the paper jam, wherein when the paper jam is detected by the paper jam detection unit, the predetermined time is different according to one of:

a shape of the paper in the paper transporting passage;

a size of the paper in the paper transporting passage;

a temperature of an image forming unit; or a fixed state of an image formed on the paper in the paper transporting passage.

2. The information processing device according to claim 1, wherein the predetermined time is different according to a position in the paper transporting passage detected by the paper jam detection unit.

3. The information processing device according to claim 2, wherein when the paper jam is detected by the paper jam detection unit in a plurality of positions in the paper transporting passage, the predetermined time is extended based on the position in which the paper jam is detected.

4. The information processing device according to claim 1, wherein when the paper jam is detected by the paper jam detection unit in a plurality of positions in the paper transporting passage, the predetermined time is extended based on a position in which the paper jam is detected.

5. The information processing device according to claim 1, further comprising:

a temperature detection unit that detects the temperature of the image forming unit, wherein when the paper jam is detected by the paper jam detection unit, the predetermined time is different according to a temperature of the image forming unit which is detected by the temperature detection unit.

6. The information processing device according to claim 1, wherein when the time measured by the time measurement unit is longer than the predetermined time, the control unit controls the paper jam status to be released when the opening and closing detection unit detects closing of the opening and closing door.

7. The information processing device according to claim 6, wherein when the paper jam is detected by the paper jam detection unit in a plurality of positions in the paper transporting passage, the predetermined time is extended based on a position in which the paper jam is detected.

8. The information processing device according to claim 6, wherein the predetermined time is different according to a position in the paper transporting passage detected by the paper jam detection unit.

9. The information processing device according to claim 8, wherein when the paper jam is detected by the paper jam detection unit in a plurality of positions in the paper transporting passage, the predetermined time is extended based on the position in which the paper jam is detected.

10. The information processing device according to claim 1, wherein when the time measured by the time measurement unit is longer than the predetermined time and the paper jam status is controlled to be released by the control unit, the predetermined time is extended in case of detecting the paper jam again by the paper jam detection unit.

11. The information processing device according to claim 10, further comprising:

a manipulation display unit that displays a screen to a user, wherein when the time measured by the time measurement unit is longer than the predetermined time and the paper jam status is controlled to be released by the control unit, the manipulation display unit displays information to an effect that the paper jam status is not released in case of detecting the paper jam again by the paper jam detection unit.

12. The information processing device according to claim 10, wherein when the time measured by the time measurement unit is shorter than the predetermined time, a manipulation display unit displays information to the effect that the paper jam status is not released.

13. A non-transitory computer readable medium storing a program causing a computer to function as:

an opening and closing detection unit that detects opening and closing of an opening and closing door which exposes a paper transporting passage for transporting paper;

a paper jam detection unit that detects a paper jam in the paper transporting passage;

a time measurement unit that measures a time when the paper jam is detected for opening then closing of the opening and closing door; and a control unit that controls a paper jam status to be continued when the time measured by the time measurement unit is shorter than a predetermined time that is deemed to be necessary for the opening and then closing of the opening and closing door for removal of the paper jam, wherein when the paper jam is detected by the paper jam detection unit, the predetermined time is different according to one of:

a shape of the paper in the paper transporting passage;

a size of the paper in the paper transporting passage;

a temperature of an image forming unit; or a fixed state of an image formed on the paper in the paper transporting passage.

14. The non-transitory computer readable medium according to claim 13, wherein the predetermined time is different according to a position in the paper transporting passage detected by the paper jam detection unit.

15. The non-transitory computer readable medium according to claim 13, wherein when the paper jam is detected by the paper jam detection unit in a plurality of positions in the paper transporting passage, the predetermined time is extended based on a position in which the paper jam is detected.

16. The non-transitory computer readable medium according to claim 13, wherein the computer is further causes to function as a temperature detection unit that detects the temperature of the image forming unit, and wherein when the paper jam is detected by the paper jam detection unit, the predetermined time is different according to a temperature of the image forming unit which is detected by the temperature detection unit.

17. The non-transitory computer readable medium according to claim 13, wherein when the time measured by the time measurement unit is longer than the predetermined time, the control unit controls the paper jam status to be released when the opening and closing detection unit detects closing of the opening and closing door.

18. The non-transitory computer readable medium according to claim 13, wherein when the time measured by the time measurement unit is longer than the predetermined time and the paper jam status is controlled to be released by the control unit, the predetermined time is extended in case of detecting the paper jam again by the paper jam detection unit.

19. The non-transitory computer readable medium according to claim 18, wherein the computer is further causes to function as a manipulation display unit that displays a screen to a user, and wherein when the time measured by the time measurement unit is longer than the predetermined time and the paper jam status is controlled to be released by the control unit, the manipulation display unit displays information to an effect that the paper jam status is not released in case of detecting the paper jam again by the paper jam detection unit.

20. The non-transitory computer readable medium according to claim 18, wherein when the time measured by the time measurement unit is shorter than the predetermined time, the manipulation display unit displays information to the effect that the paper jam status is not released.

21. An information processing device, comprising:

an opening and closing detection unit that detects opening and closing of an opening and closing door which exposes a paper transporting passage for transporting paper;

a paper jam detection unit that detects a paper jam in the paper transporting passage;

a time measurement unit that measures a time when the paper jam is detected for opening of the opening and then closing door; and a control unit that controls a paper jam status to be continued when a time measured by the time measurement unit is shorter than a predetermined time for the opening and then closing of the opening and closing door in order to remove the paper jam, wherein when the paper jam is detected by the paper jam detection unit, the predetermined time is different according to a shape of the paper in the paper transporting passage.

* * * * *